US010001352B1

(12) United States Patent
Song et al.

(10) Patent No.: US 10,001,352 B1
(45) Date of Patent: Jun. 19, 2018

(54) ARROW SHAFT AND ARROW INCLUDING THE SAME

(71) Applicants: Moon Jae Song, Busan-si (KR); Yun Sub Song, Busan-si (KR); Yoon Jae Song, Busan-si (KR)

(72) Inventors: Moon Jae Song, Busan-si (KR); Yun Sub Song, Busan-si (KR); Yoon Jae Song, Busan-si (KR)

( * ) Notice: Subject to any disclaimer, the term of this patent is extended or adjusted under 35 U.S.C. 154(b) by 0 days. days.

(21) Appl. No.: 15/587,410

(22) Filed: May 5, 2017

(51) Int. Cl.
*F42B 6/04* (2006.01)

(52) U.S. Cl.
CPC ..... *F42B 6/04* (2013.01)

(58) Field of Classification Search
CPC ..... F42B 6/04; F42B 6/06; F42B 6/08
See application file for complete search history.

(56) References Cited

U.S. PATENT DOCUMENTS 2,125,591 A * 8/1938 Smith ..... F41B 5/1415 124/24.1
5,273,293 A * 12/1993 Lekavich ..... F42B 6/04 138/173
6,595,880 B2 * 7/2003 Becker ..... F42B 6/04 124/44.5
2006/0084534 A1 * 4/2006 Flowers ..... F42B 6/04 473/578

FOREIGN PATENT DOCUMENTS

KR 20-0412026 Y1 3/2006

* cited by examiner

*Primary Examiner* — John Ricci

(57) ABSTRACT

An arrow shaft includes a body having on opposite ends thereof an arrowhead and an arrow feather, and a pattern formed on an outer circumference of the body. The pattern is helically formed along the body, and the helical pattern is formed on a predetermined region in a direction from the arrowhead to the arrow feather.

13 Claims, 7 Drawing Sheets

ARROW SHAFT AND ARROW INCLUDING THE SAME

TECHNICAL FIELD

The present disclosure relates to an arrow shaft and an arrow including the arrow shaft.

BACKGROUND ART

In general, an arrow includes a pipe-shaped arrow shaft, an arrowhead fitted into a hole of a front end of the arrow shaft, and a feather attached to an outer circumference of a rear end of the arrow shaft. A general process of manufacturing the arrow shaft includes a cutting step of cutting fabric made of glass or carbon materials into a size of the arrow shaft, a rolling step of rolling the cut glass or carbon fabric on a mandrel to be in close contact therewith, and a forming step of forming a pipe-shaped arrow shaft by detaching the mandrel after it is charged into a heating furnace and heated. Recently, there has been proposed an arrow shaft having on a surface thereof various pattern layers to provide good appearance to the arrow shaft. The arrow shaft is made by rolling the glass or carbon fabric on the mandrel into a cylindrical shape and then directly printing the pattern layer on the surface. However, this is problematic in that fine bubbles are generated on a surface of the arrow shaft in a printing process, so that the surface of the arrow shaft is not treated smoothly. Furthermore, this is problematic in that the arrow shaft may be deformed or damaged by pressure acting on an outer circumference of the arrow shaft in the printing process. Particularly, as the arrow shaft has the cylindrical shape, it is impossible to print the pattern layer on an entire surface of the arrow shaft and thereby the pattern layer may be printed on only a part of the surface of the arrow shaft. Consequently, it is difficult to achieve a desired effect using the printed pattern.

SUMMARY

An object of the present disclosure is to provide an arrow shaft and an arrow having the arrow shaft, capable of minimizing the archer's paradox in which the arrow is shaken immediately after the arrow is shot, by adjusting the height of a pattern in the arrow having the pattern on the arrow shaft.

Another object of the present disclosure is to provide an arrow shaft and an arrow having the arrow shaft, capable of minimizing the archer's paradox in which the arrow is shaken immediately after the arrow is shot, by adjusting the width of a pattern in the arrow having the pattern on the arrow shaft.

A still another object of the present disclosure is to provide an arrow shaft and an arrow having the arrow shaft, capable of minimizing the archer's paradox in which the arrow is shaken immediately after the arrow is shot, by adjusting a pitch between patterns in the arrow having the patterns on the arrow shaft.

A still yet another object of the present disclosure is to provide an arrow shaft and an arrow having the arrow shaft, in which a body and a pattern have contrasted colors, thus providing excellent visual discrimination to a user.

In one general aspect, there is provided an arrow shaft including a body being connectable an arrowhead and an arrow feather at each end; and a pattern formed on an outer circumference of the body, wherein the pattern is helically formed along the body, and the helical pattern is formed over a predetermined region on the body.

The predetermined region may be 75% or less of a length of the arrow shaft.

The predetermined region may be disposed to extend from the arrowhead or the arrow feather.

The predetermined region may be disposed to be spaced apart from the arrowhead and the arrow feather.

The helical pattern may include a plurality of patterns formed on the body, the plurality of helical patterns being formed around an axis of the body at regular angular intervals.

The plurality of helical patterns may be formed in directions intersecting with each other.

The pattern may rotate an arrow by friction between the pattern and air, when the arrow moves in the air.

The pattern may be formed at an angle of 45 degrees or less relative to a direction in which the arrow moves in the air.

A width of each of the pattern may be formed to be smaller than a pitch of the pattern.

The pitch of the pattern formed on the body may be varied depending on a position.

The pitch of the pattern may be increased in a direction away from the arrowhead.

An angle formed between an axis of the arrow shaft and the pattern may be reduced in a direction from the arrowhead to the arrow feather.

The pattern may be formed or increased in thickness by spraying paint.

In another general aspect, there is provided an arrow having the above-described arrow shaft.

An embodiment of the present disclosure provides an arrow shaft and an arrow having the arrow shaft, capable of minimizing the archer's paradox in which the arrow is shaken immediately after the arrow is shot, by adjusting the height of a pattern in the arrow having the pattern on the arrow shaft.

Another embodiment of the present disclosure provides an arrow shaft and an arrow having the arrow shaft, capable of minimizing the archer's paradox in which the arrow is shaken immediately after the arrow is shot, by adjusting the width of a pattern in the arrow having the pattern on the arrow shaft.

A still another embodiment of the present disclosure provides an arrow shaft and an arrow having the arrow shaft, capable of minimizing the archer's paradox in which the arrow is shaken immediately after the arrow is shot, by adjusting a pitch between patterns in the arrow having the patterns on the arrow shaft.

A still yet another embodiment of the present disclosure provides an arrow shaft and an arrow having the arrow shaft, in which a body and a pattern have contrasted colors, thus providing excellent visual discrimination to a user.

DETAILED DESCRIPTION

Hereinafter, preferred embodiments of the present disclosure will be described in detail with reference to the accompanying drawings. However, it should be understood that the disclosed embodiments are merely exemplary and the present disclosure is not limited to the embodiments.

Furthermore, the description of known functions or configurations will be omitted herein to make the gist of this invention clear. The terms or words used in the description and the claims of the present disclosure should not be interpreted as being limited merely to common and dictionary meanings. On the contrary, they should be interpreted based on the meanings and concepts of the invention in keeping with the scope of the invention on the basis of the principle that the inventor(s) can appropriately define the terms in order to describe the invention in the best way.

It is apparent for a person having ordinary knowledge in the art that technical spirit of the present disclosure is defined by claims and the following embodiments are for an illustrative purpose only.

Figure 1:
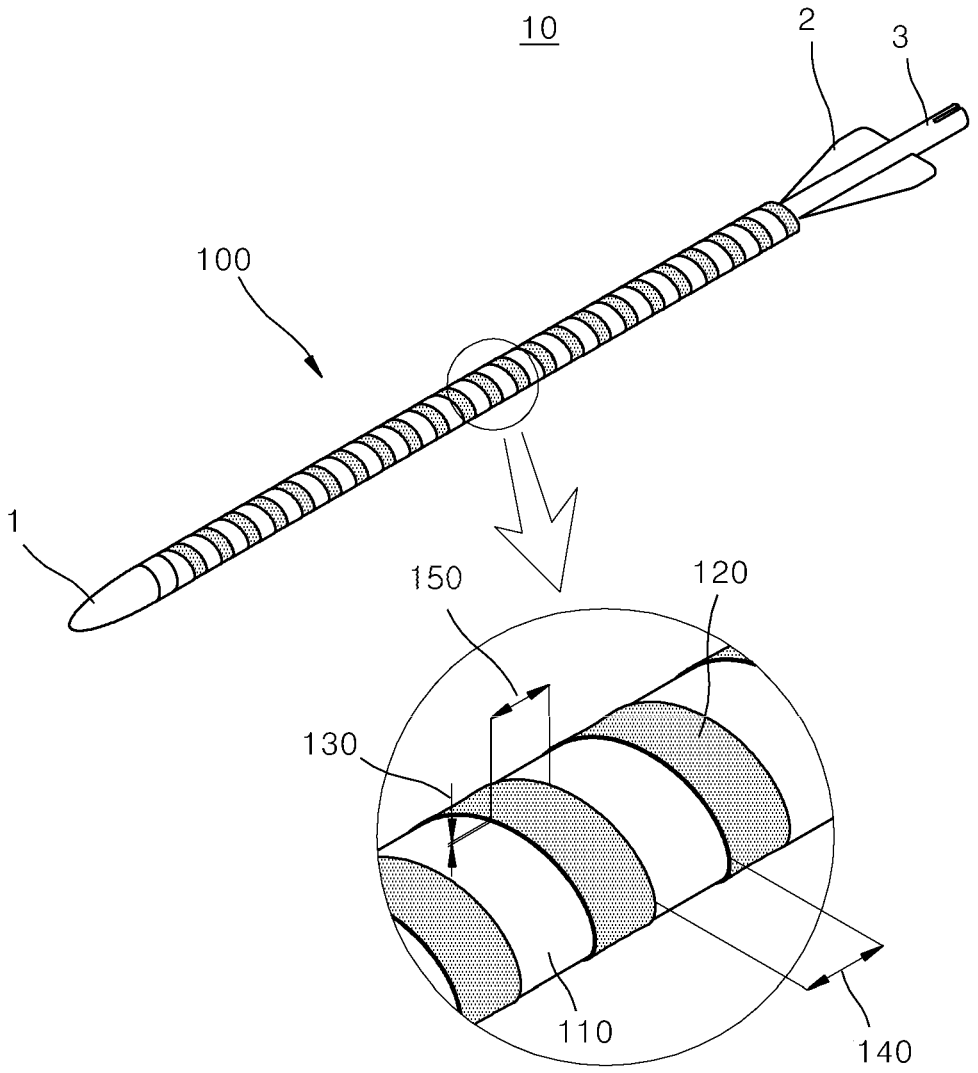
FIG. 1 is a perspective view illustrating an arrow according to an embodiment of the present disclosure.

FIG. 1 is a perspective view illustrating an arrow 10 according to an embodiment of the present disclosure.

Referring to FIG. 1, the arrow 10 may include an arrowhead 1, an arrow feather 2, and an arrow shaft 100 being connectable to the arrowhead 1 and the arrow feather 2 at each opposite end, respectively. Since embodiments of the present disclosure are directed to the arrow shaft 100, the description of the arrowhead 1 and the arrow feather 2 will be omitted hereinafter. The arrow shaft 100 according to an embodiment of the present disclosure may form a pattern 120 on an outer circumference of the body 110.

Figure 2A:
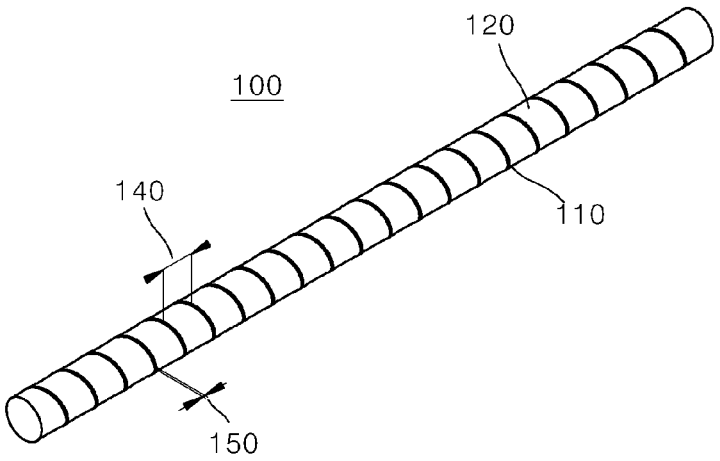
FIG. 2A is a perspective view illustrating an arrow shaft according to another embodiment of the present disclosure.
Figure 2B:
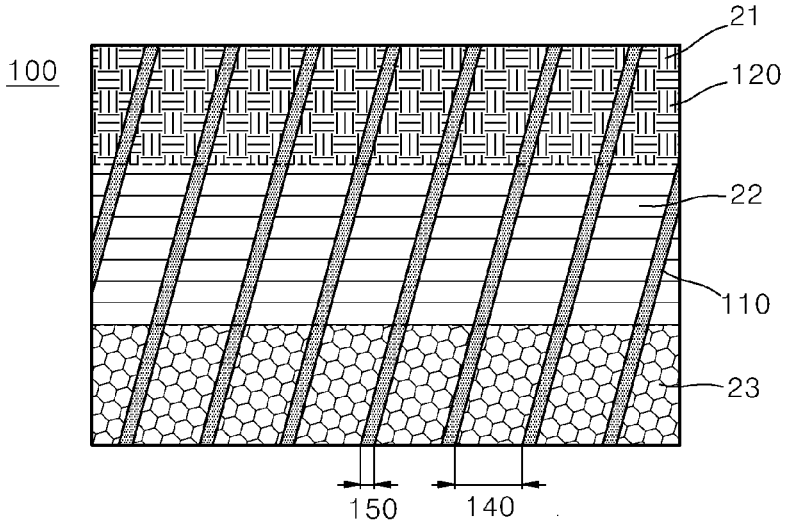
FIG. 2B is a development view illustrating the arrow shaft according to another embodiment of the present disclosure.

First, as a method of manufacturing the arrow shaft 100, there has been proposed a method of manufacturing the pipe-shaped arrow shaft 100 by rolling carbon fibers 20 (21, 22, 23 of FIGS. 2A and 2B). Here, a grid density of the carbon fibers 20 may be a factor that affects performance after the arrow shaft 100 is shot from a bowstring. Thus, the arrow shaft 100 may be manufactured such that front and rear sides of the arrow shaft are different in grid density of the carbon fibers 20 from each other. For example, the arrow shaft 100 of a multi-stage spine structure may be formed. FIGS. 2A and 2B and FIGS. 3A and 3B are exemplified development views illustrating arrow shafts 100, 200, 300 and 400 each having a three-stage spine structure.

The above-described manufacturing method may suppress a phenomenon in which the arrow shaft 100 is repetitively bent when the arrow 10 is shot from the bowstring and then travels towards a target, namely, "archer's paradox". For example, the arrow shaft 100 having high-elasticity carbon fibers in aluminum is low in strength. The shorter the length of the arrow shaft is, the more repetitively the arrow shaft 100 is bent in the air. The slower the arrow 10 flies, the worse the phenomenon becomes.

Therefore, as one of methods for increasing the flying stability of the arrow 10, the present disclosure discloses the arrow shaft 100 having the body 110 on which the pattern 120 is formed. The pattern 120 formed on the body 110 of the present disclosure may be formed with various conditions to improve the flying stability of the arrow 10. The conditions for the pattern 120 may include an angle of the pattern 120 formed on the body 110, a pattern width 150, a pattern pitch 140, a pattern height 130, and others.

The pattern 120 may be helically formed. Alternatively, a plurality of patterns may be formed on the arrow shaft 100. When the plurality of patterns 120 is formed on the arrow shaft 100, the respective patterns 120 may be spaced apart from each other at regular angular intervals clockwise and counterclockwise with respect to an axis of the pipe-shaped arrow shaft 100. For example, two patterns 120 may be spaced apart from each other at the angle of 180 degrees. In the case of having three patterns 120, they may be spaced apart from each other at the angle of 120 degrees.

The same angle allows a rotating force to be generated on the arrow 10 by friction between the air and the helical pattern 120 while the arrow 10 flies. The rotating force may improve linearity when the arrow flies, in addition to increasing a flying distance and accuracy. Such a configuration induces the rotation of the arrow 10, thus mitigating the phenomenon where the flying stability is decreased by the paradox occurring during the flying of the arrow 10, using gyro effects.

FIGS. 2A and 2B are views illustrating the arrow shaft 100 according to the present disclosure. FIG. 2A is a perspective view illustrating an arrow shaft 100 according to another embodiment of the present disclosure, and FIG. 2B is a development view illustrating the arrow shaft 100 according to another embodiment of the present disclosure.

Referring to FIGS. 2A and 2B, the arrow shaft 100 may include a pattern 120. For example, when the arrow shaft 100 is manufactured into the shape of FIG. 2A by rolling the body 110 made of carbon fibers 20 (21, 22, 23) having equal density or different densities in a direction from the developed state of FIG. 2B, it is possible to optionally form the pattern forming angle, the pattern height 130, the pattern pitch 140 and the pattern width 150 on the body 110 in the developed state of FIG. 2B. These conditions may be correlated with the flying stability and the strength of the arrow 10. Particularly, in order to improve the flying stability, the pattern forming angle, the pattern height 130, the pattern pitch 140 and the pattern width 150 may be varied.

Other embodiments will be described with reference to FIGS. 3A to 3C.

Figure 3A:
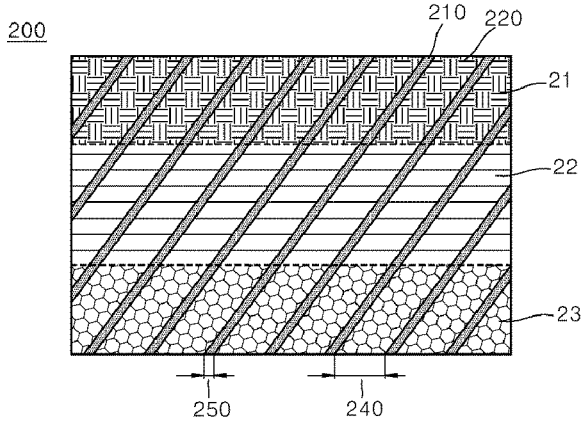
FIG. 3A is a development view illustrating an arrow shaft according to a further embodiment of the present disclosure.
Figure 3B:
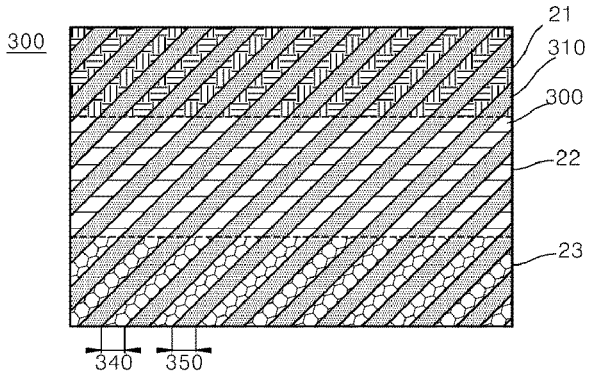
FIG. 3B is a development view illustrating an arrow shaft according to yet another embodiment of the present disclosure.
Figure 3C:
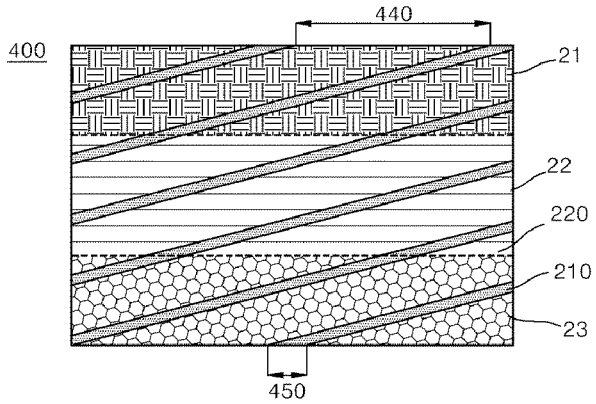
FIG. 3C is a development view illustrating an arrow shaft according to still another embodiment of the present disclosure.

FIG. 3A is a development view illustrating an arrow shaft 200 according to a further embodiment of the present disclosure, FIG. 3B is a development view illustrating an arrow shaft 300 according to yet another embodiment of the present disclosure, and FIG. 3C is a development view illustrating an arrow shaft 400 according to still another embodiment of the present disclosure.

Referring to FIG. 3A, the pattern 220 is formed as follows: the forming angle of the pattern 220 formed on the body 210 is within a range from 45 degrees or more to 90 degrees with respect to a direction in which the arrow 10 is shot and travels in the air. According to this embodiment, since the pattern pitch 240 is larger than the pattern width 250 of the pattern 220, an area of the pattern 220 facing the air may be small. However, if the forming angle of the pattern 220 is 45 degrees or more but is less than 90 degrees and the pattern has the constant pattern pitch 240, it is possible to increase the area of the pattern 220 exposed to the air compared to the pattern whose forming angle is less than 45 degrees. Thus, it is possible to regulate effects caused by the friction between the pattern and the air.

When comparing the arrow shaft of FIG. 3B with that of FIG. 3A, effects caused by the friction with the air larger than those of FIG. 3A may be expected. Since a pattern pitch 340 is narrow and thereby more patterns 320 may be accommodated compared to the patterns of FIG. 3A, more frictional surfaces with the air may be formed.

Moreover, in order to further increase the effects due to the friction, a pattern height 330 may be increased. For example, the pattern 320 may be formed by spraying paint onto the body 310 in the state where the carbon fibers 20 (21, 22, 23) are unrolled. Alternatively, the pattern 320 may be formed by spraying paint onto the body 310 in the state where the carbon fibers 20 (21, 22, 23) are rolled. Moreover, it is possible to increase the pattern height 330 not only by forming the pattern but also by further spraying paint onto the formed pattern 320.

In this connection, the term "spraying" means that particles constituting the pattern 320 are sprayed to adhere to the body 310. By spraying the particles contrasted with the body 310, the pattern may be visually clearly displayed. For example, if the body 310 has a black color, the pattern 320 may be yellow.

The method of forming the pattern 320 and increasing the height may be applied to all embodiments of the present disclosure without being limited to the embodiment of FIG. 3B.

Referring to FIG. 3C, the pattern forming angle may be less than 45 degrees, unlike the embodiment of FIG. 3A. In this case, the area of a pattern 420 exposed to the air may be relatively less than that of the above-described embodiment. In this case, a material sprayed to form the pattern 420 may be larger in frictional force with the air than that of the above-described embodiment. That is, when the air flows towards the arrow feather 2 while being in contact with the pattern 420, the rotating force may be generated on the arrow 10 by the helically formed pattern 420.

Figure 4A:
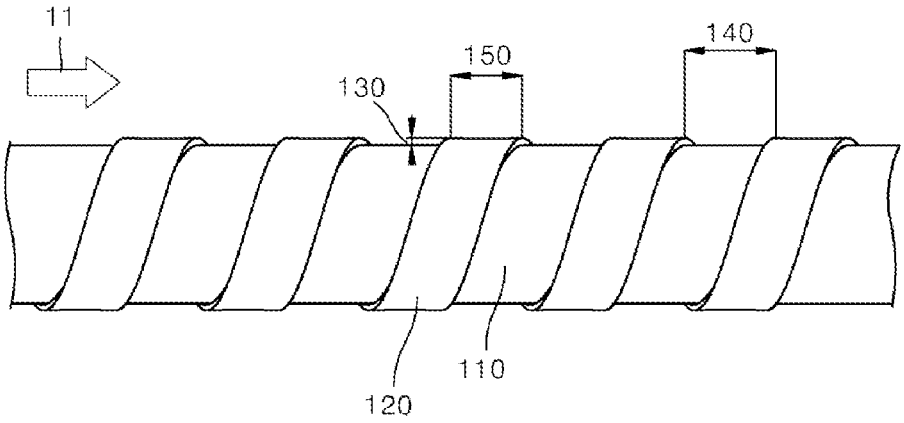
FIG. 4A is a view illustrating a pattern of the arrow shaft according to the embodiment of the present disclosure.
Figure 4B:
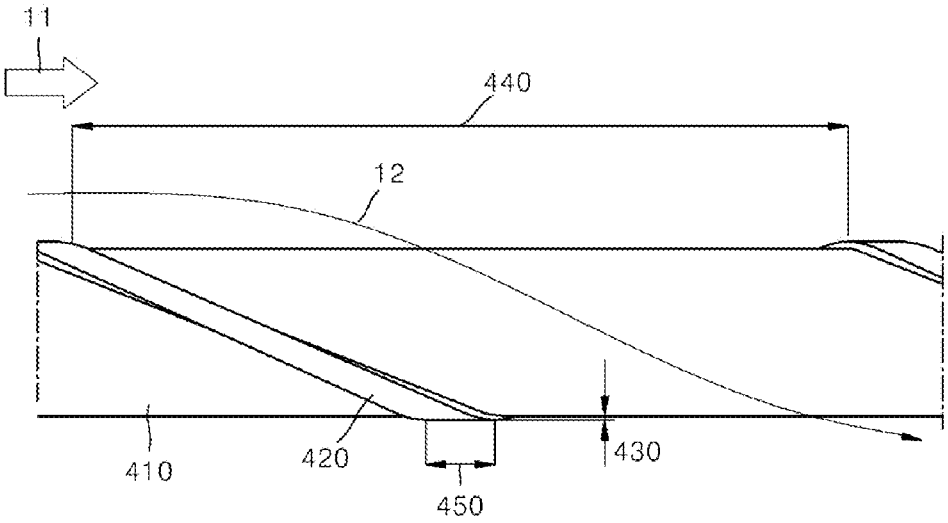
FIG. 4B is a view illustrating a pattern of an arrow shaft according to another embodiment of the present disclosure.

FIGS. 4A and 4B are views illustrating the state in which the arrow shafts 100 and 400 according to embodiments of the present disclosure move across fluid. FIG. 4A is a view illustrating the pattern 120 of the arrow shaft 100 according to the embodiment of the present disclosure, and FIG. 4B is a view illustrating the pattern 420 of the arrow shaft 400 according to another embodiment of the present disclosure.

Referring to FIGS. 4A and 4B, if the forming angle of the pattern 420 is formed to be less than 45 degrees and a pattern pitch 440 is formed long, the embodiment of FIG. 4B is obtained. In this case, if the forming angle is more than 45 degrees and the pattern pitch 440 is formed to be relatively short as in FIG. 4A, the area of the pattern 420 formed on the body 410 becomes smaller, and thereby a frictional amount between the air and the pattern 420 may be reduced. Therefore, effects due to the friction between the air and the pattern 420 may be reduced.

Furthermore, the effects of the pattern forming angle may be increased depending on the pattern height 430. To be more specific, as one of methods for increasing effects due to the friction with the air, the pattern height 430 may be increased by spraying paint or the like. The pattern 420 with the increased height may increase the frictional area with the air. Furthermore, a helical path is formed along the body 410 by a height difference between the body 410 and the pattern 420, so that it is possible to rotate the arrow shaft 400 by collision or friction between the air and the pattern 420. Therefore, the rotating force of the arrow shaft rotated by the air may vary depending on the above-described forming angle.

For example, the pattern height 430 may be formed to be within a range from 0.025 mm or more to 0.5 mm or less. That is, if the pattern height 430 is formed to be less than 0.025 mm, a path allowing the air to flow along the body 410 may not be formed. If the pattern height is more than 0.5 mm, the path is formed but the collision between the air and the pattern 420 occurs due to the height difference between an outer circumference of the body 410 and the pattern 420 while the air is introduced into the path, thus leading to an increase in resistance when the arrow flies.

Accordingly, the state in which the path is formed may further affect the above-described pattern forming angle. For example, since additional factors may be caused by collision as well as friction between the air and the pattern 420, the resistance or the rotating force transmitted from the air to the arrow shaft 400 may be increased. Of course, when the forming angle is less than 45 degrees as shown in FIG. 4B, an air moving direction 12 may be rotated along the path. However, as the forming angle exceeds 45 degrees but approximates 90 degrees, a collision point between the air and the pattern 420 is created, so that the flying stability may be rather decreased. Furthermore, when the forming angle approximates to 0 degree, the friction between the air and the pattern 420 is less than a force for generating the rotating force, resistance is likely to increase during the flying. Consequently, the forming angle may be within a range from 20 degrees or more to 70 degrees or less.

Figure 5A:
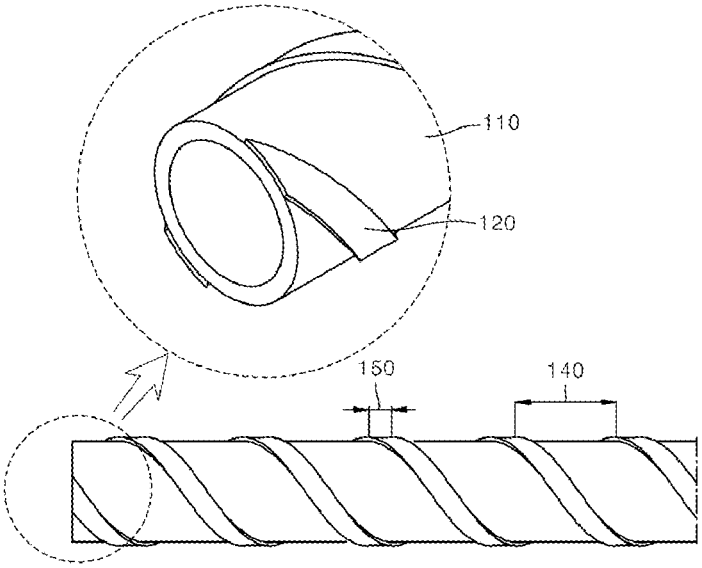
FIG. 5A is a view illustrating the pattern of the arrow shaft according to an embodiment of the present disclosure.
Figure 5B:
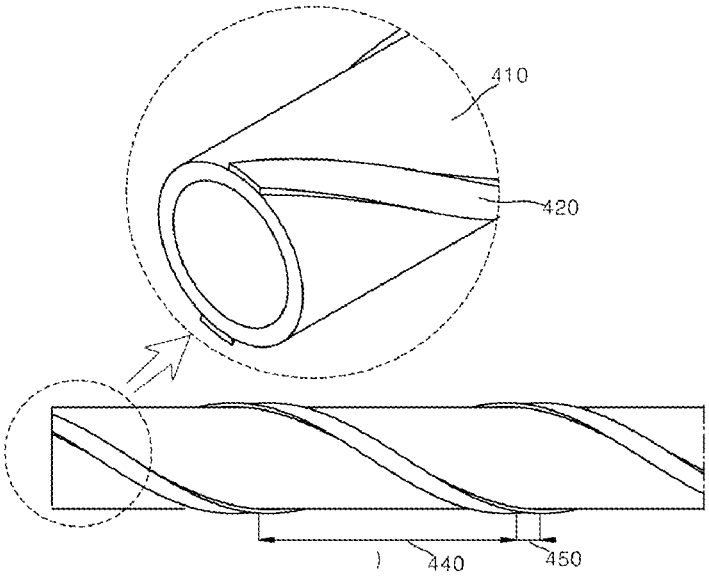
FIG. 5B is a view illustrating the pattern of the arrow shaft according to another embodiment of the present disclosure.

FIG. 5A is a view illustrating the body 110 of the arrow shaft 100 according to the embodiment of the present disclosure, and FIG. 5B is a view illustrating the body 410 of the arrow shaft 400 according to another embodiment of the present disclosure.

Referring to FIGS. 5A and 5B, the pattern pitches 140 and 440 and the number of the patterns 120 and 420 may be varied. Moreover, each of the pattern pitches 140 and 440 may be different between front and rear sides in a moving direction even on one arrow shaft 100, 400. For example, if the center of gravity is in the front side of the arrow while the arrow 10 is repetitively bent during its flying, the pattern height 130, 430 may be gradually reduced from the front side to the rear side of the arrow shaft 100, 400 so as to mitigate the shaking of the rear side of the flying arrow. For example, the pattern height 430 may be gradually reduced by 20% or less relative to a neighboring pattern 420 in a pitch direction. The pattern 420 may be reduced linearly or non-linearly within the above-described range. The gradual reduction prevents the rear side of the arrow shaft 410 from being affected by the pattern 420, and prevents the pattern 420 from extending to an end of the arrow shaft 410.

Furthermore, the pattern height 430 is reduced at the rate of 20% or less. To be more specific, the pattern 420 may extend to a predetermined point while the pattern height is not reduced at the front side, and then the pattern height may be abruptly reduced. For example, the pattern 420 may extend without a change in pattern height 430 from the front side of the arrow shaft 410 to a distance corresponding to 30% of the length of the arrow shaft 410, and then the pattern height may be reduced at the rate of 20%. This example ensures the flying stability of the arrow through the pattern 420 formed on the front side of the arrow shaft 410, and reduces the effects of the pattern at a position adjacent to the rear side, thus maintaining an impelling force by the rear side of the arrow shaft 410.

Moreover, each of the pattern pitches 140 and 440 may be formed to be gradually increased. For example, each of the pattern widths 150 and 450 may be formed within a range from 1 cm or more to 5 cm or less, and may be reduced by 10% or less of the pattern width 450 of a neighboring preceding pattern, in a direction towards the rear side of the arrow shaft 410. The reduction of the pattern width 450 minimizes the effects due to the pattern 420, namely, the effects due to the friction between the air and the pattern 420, towards the end of the pattern 420.

The above-described configuration allows effects due to the pattern 120, 420 to be reduced towards the rear side in the moving direction of the arrow 10. That is, the gyro effects are maximized by rotating the arrow 10 via the pattern 120, 420, and simultaneously no pattern 120, 420 is formed on the rear side of the arrow 10, thus generating the impelling force of the arrow. Moreover, as the structure for generating the impelling force, the pattern 420 may be formed within 75% of the length of the body 410, and the pattern may be formed from an end of the arrow shaft 410. Of course, a structure for minimizing effects due to the air may be provided on a portion beyond 75% in the flying direction of the arrow 10, namely, on a rear portion of the arrow shaft.

Figure 6A:
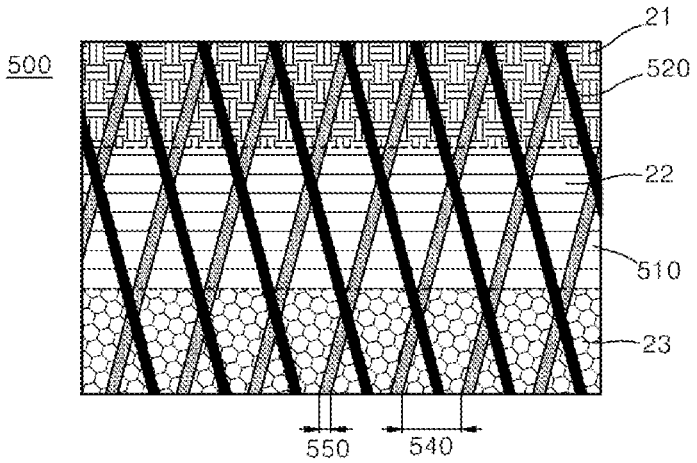
FIG. 6A is a view illustrating a pattern of an arrow shaft according to a further embodiment of the present disclosure.
Figure 6B:
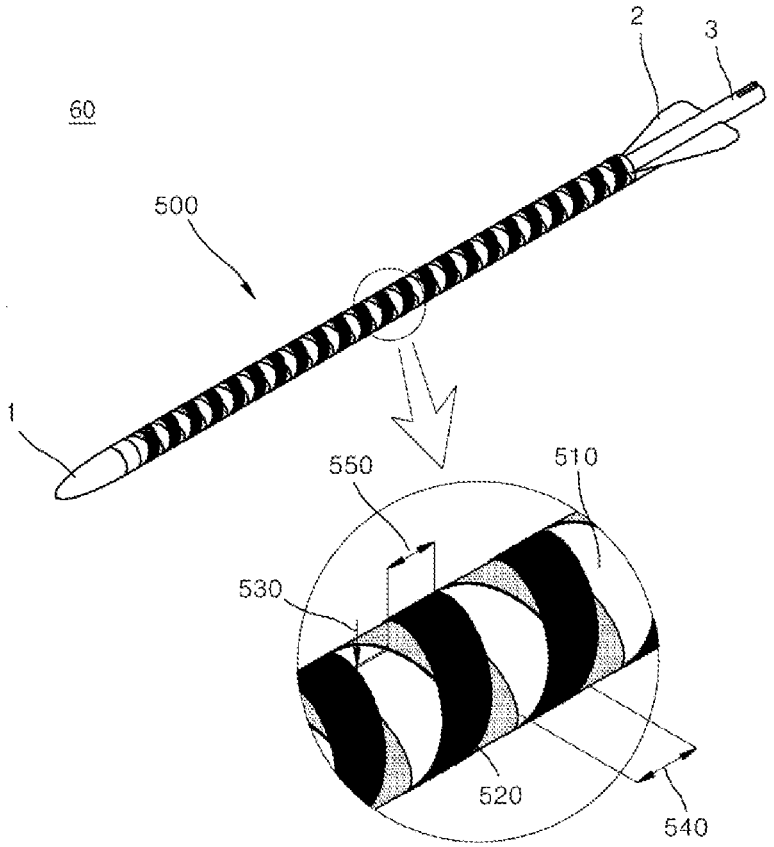
FIG. 6B is a view illustrating an arrow including the arrow shaft according to the further embodiment of the present disclosure.

FIG. 6A is a view illustrating a pattern 520 of an arrow shaft 500 according to a further embodiment of the present disclosure, and FIG. 6B is a view illustrating an arrow 60 including the arrow shaft 500 according to the further embodiment of the present disclosure.

Referring to FIGS. 6A and 6B, the arrow shaft 500 may have a plurality of patterns 520 that are formed at a predetermined angle relative to an axial direction of the arrow shaft 500. The plurality of patterns may intersect with each other. The patterns 520 formed in different directions may have different forming conditions, such as a formed angle, a height 530, a pitch 550 and a width 540. Effects depending on the forming conditions have been described above. Furthermore, a position of the pattern 520 formed on the body 510 may be a front side, a rear side and a central side in the flying direction of the arrow 60.

Figure 7A:
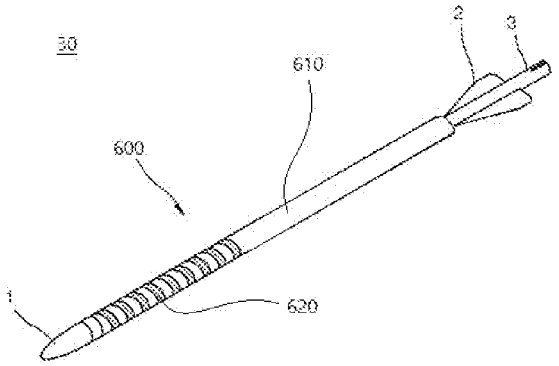
FIGS. 7A to 7C are views illustrating patterns of arrow shafts according to other embodiments of the present disclosure.
Figure 7B:
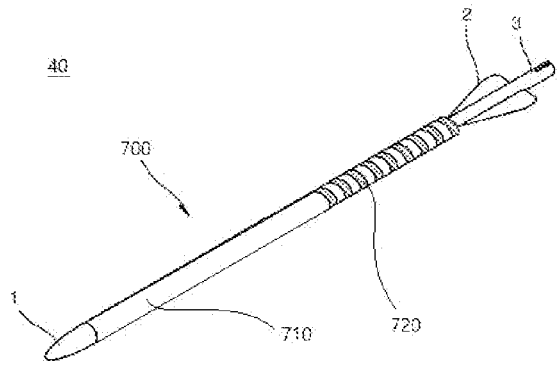
Figure 7C:
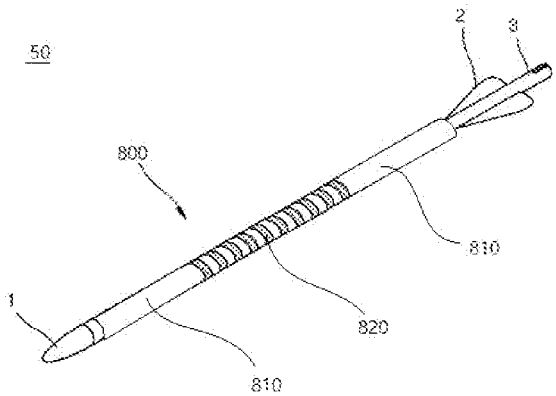

Referring to FIGS. 7A to 7C, positions of patterns 620, 720 and 820 of arrow shafts 600, 700 and 800 may be optionally determined. The pattern 620 may extend by a predetermined length from the arrowhead 1 to the arrow feather 2, and the pattern 720 may extend by a predetermined length from the arrow feather 2 to the arrowhead 1. Furthermore, the pattern 820 may be formed in areas other than the opposite ends of the body 810.

Here, the pattern 620, 720, 820 may be formed to be 75% or less of the entire length of the body 610, 710, 810. For example, the area of the pattern 620, 720, 820 may be formed by a length corresponding to 40% of the entire length of the body 610, 710, 810. Although preferred embodiments of the present disclosure have been described for illustrative purposes, those skilled in the art will appreciate that various modifications, additions and substitutions are possible, without departing from the scope and spirit of the invention as disclosed in the accompanying claims.

What is claimed is:

1. An arrow shaft, comprising:

a body being connectable to an arrowhead and an arrow feather at each end; and a pattern formed on an outer circumference of the body, wherein the pattern is helically formed along the body, and the helical pattern is formed over a predetermined region on the body, and wherein the pattern is formed or increased in thickness by spraying paint.

2. The arrow shaft of claim 1, wherein the predetermined region is 75% or less of a length of the arrow shaft.

3. The arrow shaft of claim 2, wherein the predetermined region is disposed to extend from the arrowhead or the arrow feather.

4. The arrow shaft of claim 2, wherein the predetermined region is disposed to be spaced apart from the arrowhead and the arrow feather.

5. The arrow shaft of claim 1, wherein the helical pattern comprises a plurality of patterns formed on the body, the plurality of helical patterns being formed around an axis of the body at regular angular intervals.

6. The arrow shaft of claim 5, wherein the plurality of helical patterns are formed in directions intersecting with each other.

7. The arrow shaft of claim 1, wherein the pattern rotates an arrow by friction between the pattern and air, when the arrow moves in the air.

8. The arrow shaft of claim 7, wherein the pattern is formed at an angle of 45 degrees or less relative to a direction in which the arrow moves in the air.

9. The arrow shaft of claim 1, wherein a width of each of the pattern is formed to be smaller than a pitch of the patterns.

10. The arrow shaft of claim 1, wherein pitch of the pattern formed on the body is varied depending on a position.

11. The arrow shaft of claim 10, wherein the pitch of the pattern is increased in a direction away from the arrowhead.

12. The arrow shaft of claim 1, wherein an angle formed between an axis of the arrow shaft and the pattern is reduced in a direction from the arrowhead to the arrow feather.

13. An arrow having an arrow shaft, comprising:

a body being connectable to an arrowhead and an arrow feather at each end; and a pattern formed on an outer circumference of the body, wherein the pattern is helically formed along the body, the helical pattern is formed over a predetermined region on the body, and wherein the pattern is formed or increased in thickness by spraying paint.

* * * * *